US005647092A

United States Patent [19]

Miwa

[11] Patent Number: 5,647,092

[45] Date of Patent: Jul. 15, 1997

[54] RECIRCULATING TYPE CLEANER

[75] Inventor: Hirohide Miwa, Kawasaki, Japan

[73] Assignee: Miwa Science Laboratory Inc., Kanagawa, Japan

[21] Appl. No.: 495,996

[22] Filed: Jun. 28, 1995

Related U.S. Application Data

[63] Continuation-in-part of Ser. No. 139,714, Oct. 22, 1993, Pat. No. 5,457,848.

[30] Foreign Application Priority Data

Oct. 26, 1992 [JP] Japan ..... 4-287278
Dec. 24, 1992 [JP] Japan ..... 4-344307

[51] Int. Cl.[6] ..... A47L 5/14

[52] U.S. Cl. ..... 15/346; 15/397; 15/402

[58] Field of Search ..... 15/345, 346, 402, 15/397

[56] References Cited

U.S. PATENT DOCUMENTS

| | | | |
|---|---|---|---|
| 1,383,455 | 8/1921 | Farnsworth | 15/346 |
| 1,383,456 | 7/1921 | Farnsworth | 15/346 |
| 2,064,344 | 12/1936 | Good | 15/346 |
| 2,592,710 | 4/1952 | Kirby | 15/319 |
| 3,268,942 | 8/1966 | Rossnan | 15/346 |
| 3,611,473 | 10/1971 | Johnson | 15/397 |
| 3,694,848 | 10/1972 | Alcala | 15/346 |
| 4,017,938 | 4/1977 | Crise | 15/346 |
| 4,207,650 | 6/1980 | Crise | 15/346 X |
| 4,300,261 | 11/1981 | Woodward et al. | 15/345 |
| 4,333,205 | 6/1982 | Woodward et al. | 15/345 |
| 4,594,749 | 6/1986 | Waterman | 15/345 |

FOREIGN PATENT DOCUMENTS

| | | | |
|---|---|---|---|
| 977910 | 11/1975 | Canada | 15/346 |
| 1542802 | 9/1968 | France | 15/346 |
| 2455878 | 1/1981 | France | 15/346 |
| 2218351 | 11/1973 | Germany | 15/346 |
| 4135406 | 5/1992 | Germany | 15/246 |

*Primary Examiner*—Chris K. Moore
*Attorney, Agent, or Firm*—Pollock, Vande Sande & Priddy

[57] ABSTRACT

In a recirculating type cleaner a dust collecting head having a dust collecting port in the bottom thereof is provided, and a nozzle is provided in the dust collecting head. At least a fraction of the after-flow air of a fan is passed through a recirculating tube to the nozzle from which air jet is issued. A contact member is provided in the dust collecting head for contacting carpet piles being cleaned within a portion of the region of the dust collecting port to bend the piles down in the sweeping direction when the cleaner is moved in its sweeping stroke, whereby a gorge is opened in the piles. The nozzle is oriented such that the air jet issued through the nozzle is directed to the bottom of the gorge. Pile bend inverting member is also provided to create the gorge positively by mechanical pushing of the piles just behind the gorge to the reverse direction of the cleaning stroke.

6 Claims, 8 Drawing Sheets

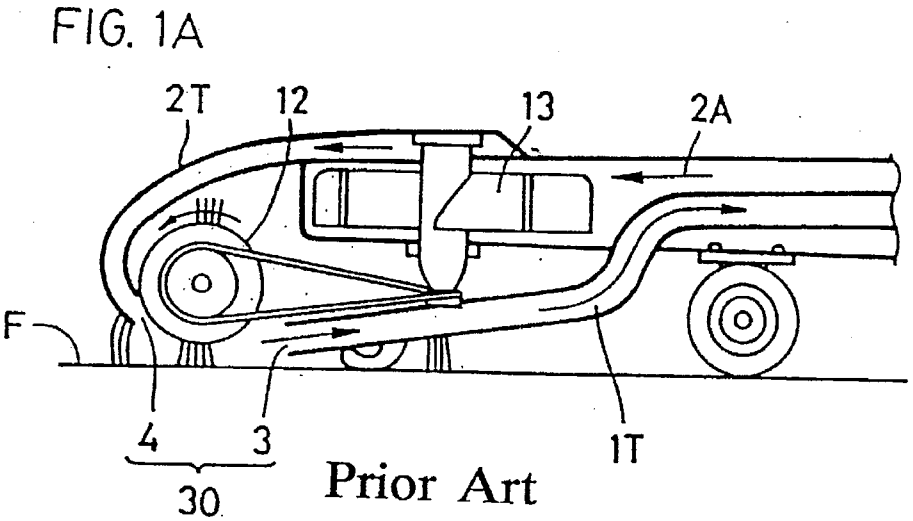
FIG. 1A Prior Art
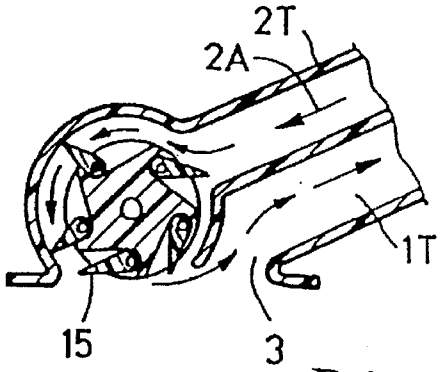
FIG. 1B Prior Art
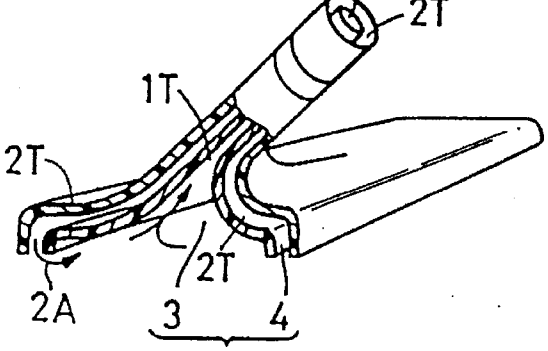
FIG. 1C Prior Art
FIG. 1D Prior Art
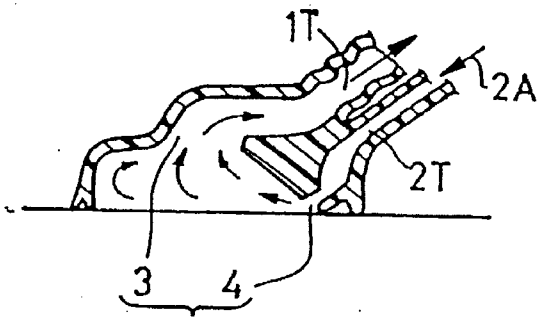
FIG. 1E Prior Art FIG. 2A1
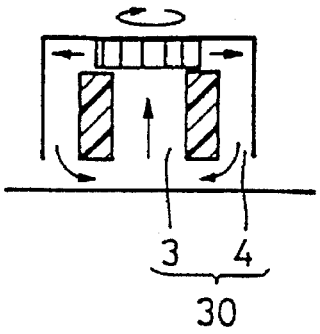
FIG. 2A2
Prior Art
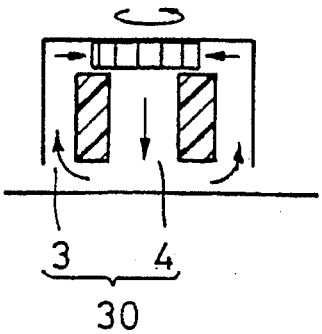
FIG. 2B
Prior Art
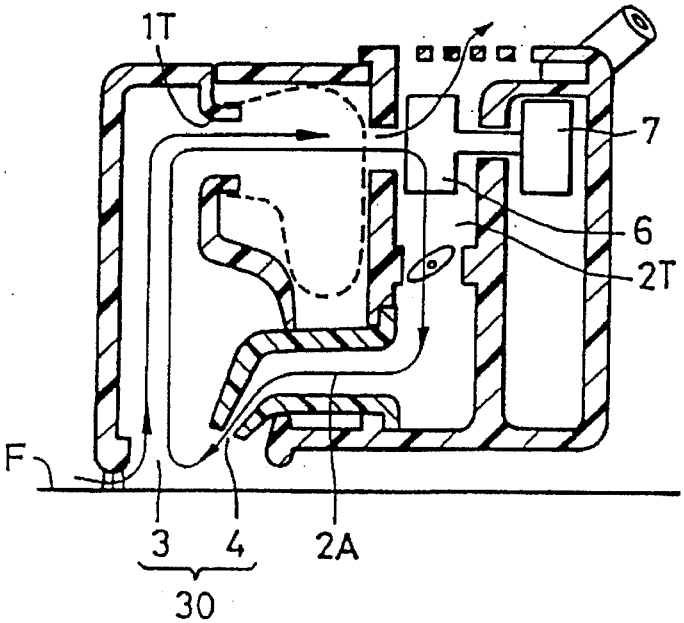
FIG. 2C
Prior Art
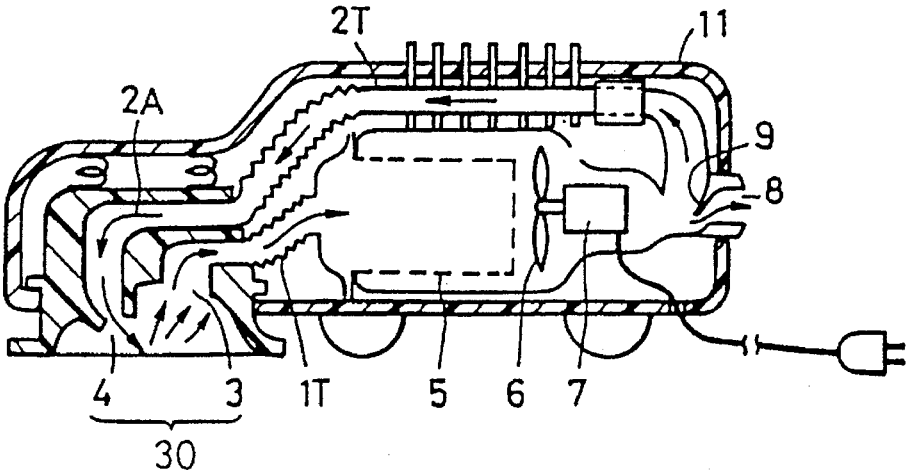

RECIRCULATING TYPE CLEANER

CROSS-REFERENCE TO RELATED APPLICATION

This application is a continuation-in part of application Ser. No. 08/139,714 filed on Oct. 22, 1993 and entitled "Recirculating Type Cleaner", now U.S. Pat. No. 5,457,848, issued Oct. 17, 1995.

TECHNICAL FIELD

This invention relates generally to an electric vacuum cleaner and particularly to a recirculating type cleaner in which the airflow downstream of the suction fan (referred to as "after-flow air" hereinafter) is recirculated back to the suction port to utilize the energy of the after-flow air to thereby reduce aural noise to the exterior and prevent fine dust from being exhausted to the exterior as well as improving the cleaning efficiency per unit electric power.

BACKGROUND OF THE INVENTION

In an attempt to enhance the cleaning efficiency of carpets, various types of vacuum cleaners have heretofore been commercialized. Examples of such vacuum cleaners of the non-recirculating type include ones which utilize suctioned airflow to rotate a turbine to thereby drive a carpet cleaning brush means and ones which employ a small specialized motor rather than utilizing airflow to drive a carpet cleaning brush means or a carpet beating mechanism. The motor-driven brush means was disclosed in as old a patent as U.S. Pat. No. 2,592,710 in 1952, for example.

In the recirculating type of cleaner, the following approaches to enhancing the cleaning efficiency of carpets have been proposed as illustrated in FIGS. 1A–1E and 2A–2C:

Approach 1

As schematically shown in FIG. 1A, for example, this approach is to employ the after-flow air 2A to rotate a turbine impeller 13 which in turn rotates a rotary brush 12 for removing dust. An example of this approach is disclosed in Japanese utility model publication Kokoku No. 39-36553 published on July 7, 1962.

Approach 2

As schematically shown in FIG. 1B, for example, this approach is characterized by driving a beating vibratory means 15 by the after-flow air 2A. An example of this approach is disclosed in Japanese patent publication Kokai No. 3-162814 published on July 6, 1990.

Approach 3

As illustrated in FIG. 1C or 1D, for example, this approach is to direct the after-flow air 2A, as jets if required, in a direction generally parallel to the surface F being cleaned to be drawn into an opposing suction port 3 in which the flow is created by both the forcing positive pressure and the suction rather than the suction alone from the atmosphere as in the non-recirculating type cleaner. The arrangement of FIG. 1C is disclosed in the aforesaid Japanese utility model publication Kokoku No. 39-36553 and Japanese utility model publication Kokoku No. 43-22616 (published on Oct. 5, 1964). The arrangement of FIG. 1D is shown in Japanese patent publication Kokai No. 48-46157 (published on Oct. 1, 1971).

Approach 4

As illustrated in FIG. 1E or FIG. 2B, 2C for example, this approach is to discharge the after-flow air 2A in the form of jet through a narrow outlet 4 against the surface F being cleaned at an angle of 0° to 60° relative to the surface F to blow up the dust to be suctioned into an opposing suction mouth 3. The arrangements of FIG. 1E, FIG. 2B and FIG. 2C are disclosed in Japanese patent publication Kokai No. 48-101764, (published on Apr. 8, 1972), Japanese utility model publication Kokai No. 60-188553 (published on May 24, 1984) and Japanese patent publication Kokai No. 3-162814, respectively.

In the approaches 3 and 4, the configuration of the dust collecting port 30 as viewed from the surface F being cleaned (what comprises an outlet means 4 and a suction port means 3 is generally called "dust collecting port") may take various forms as will be described below:

(A) The suction port 3 is most often located within the region of the outlet 4 as illustrated in FIGS. 1C, 1D and 2A1 (Japanese patent publication Kokai No. 58-175528). In some cases, however, the dust collecting port 30 may comprise a one-sided outlet 4 and a one-sided suction port 3 as shown in FIGS. 1A, 1E and 2B.

(B) As illustrated in FIG. 2A2 (Japanese patent publication Kokai No. 58-175528), a single outlet 4 may be provided within a suction port 3.

The prior art cleaners as described hereinabove have the following subjects to be solved:

(a) In the case where the after-flow energy is utilized, the arrangement as shown in FIGS. 1A and 1B for employing the after-flow to rotate the turbine impeller 13 for the purpose of rotating the rotary brush 12 or to provide beating and vibrating actions had the disadvantages that it was not efficient in converting the aerodynamic energy to mechanical energy and that a required amount of power taken from the after-flow would result in a build-up in the back pressure of the fan, that is, the pressure behind the fan on the side close to the exhaust port.

(b) In the non-recirculating system the air drawn from the atmosphere is caused to flow parallel to the surface being cleaned to remove the dust engaged by or entrained in the airflow. The prior art shown in FIGS. 1C and 1D is an improvement over this parallel flow system in which the efficiency of loosening the dust is enhanced by moving the after-flow air 2A directly against and along the surface being cleaned toward the opposing suction port 3 so as to suction the air from the recirculating air rather than from the atmosphere. While this parallel flow system indeed proved to be superior to the non-recirculating system and the mechanical converting system, it had difficulty with satisfactorily blowing off dust entrapped at the roots of the carpet piles as the air flow swept through only the upper half portions of the pile. Nor was it capable of blowing off dust caught in recessed grooves. It is for this reason that power brushes and the like were developed for use with the conventional suction type cleaner. But still, the bristle of the brush was not well capable of reaching the roots of carpet wool or the bottoms of recessed grooves, so that the cleaning ratio was only on the order of 30% to 60% for long-pile carpets.

(c) With the system (shown in FIGS. 1E, 2B and 2C) in which the after-flow air was discharged through a constricted orifice as a jet at an angle against the surface being cleaned, it was possible to deliver some portion of the airflow to the roots of carpet piles or the bottoms of recessed grooves to loosen the dust more effectively than the parallel flow system, but not sufficiently. Moreover, the airflow was discharged in one direction, so that it was hard to remove dust entrapped behind the piles.

(d) With the arrangement having the outlet means 4 for discharging the recirculated flow located at the outer periphery of the dust collecting port 30 as illustrated in FIGS. 1C, 1D and 2A1 with a view to preventing blowing out of contaminated streams and the resultant scattering of dust in a room, contaminated streams containing fine particles which have not been filtered out even through a filter undesirably issued out through a gap between the dust collecting port 30 and the surface F being cleaned to the surrounding atmosphere, resulting in scattering the surrounding dust.

In an attempt to overcome this drawback, U.S. Pat. No. 3,268,942, for example, teaches more effectively removing dust from recessed grooves and root portions of the carpet wool or piles by using a number of jet nozzles to form a recirculated flow outlet means located in the region of the dust collecting port and orienting the jet nozzles at a discharge angle of about 90° relative to the surface F being cleaned. However, it cannot be said that even such a cleaner has adequate ability to remove dust entrapped at the roots of the carpet piles.

SUMMARY OF THE INVENTION

Accordingly, it is an object of this invention to provide a recirculating type cleaner capable of removing dust entrapped at the roots of the carpet piles with high efficiency.

According to this invention, a recirculating type cleaner is provided which comprises:

a housing defining a dust collecting chamber therein;

a dust collecting head connected to said housing and having a dust collecting port means in the bottom thereof;

a nozzle means provided within said dust collecting head and having outlet means at a lower end thereof for discharging the air downwardly;

a fan positioned in said dust collecting chamber for exhausting the air from said chamber to the exterior;

a suction tube for passing the air drawn from said dust collecting head to said dust collecting chamber;

a recirculating tube for passing at least a fraction of the after-flow air of said fan to said nozzle means; and a pile bending-down means provided within said dust collecting head and adapted to engage the carpet piles in a region of said dust collecting port means during the sweeping stroke of the cleaner to bend the piles down to the sweeping direction and thereby open a gorge in the piles, said nozzle means being oriented to direct the air to the bottom of the gorge.

It is thus to be appreciated that the present invention provides for bending the piles down to the sweeping direction in the portion just ahead of the portion being blown by the air from the nozzle, whereby a gorge is formed by the air jet through even long carpet wool, resulting in an improved cleaning efficiency.

BRIEF DESCRIPTION OF THE DRAWINGS

These and other more detailed and specific objects and features of the present invention will be more fully disclosed in the following specification with reference to the accompanying drawings, in which:

FIG. 1A is a cross-sectional view of a prior art recirculating type cleaner showing a pertinent part thereof;

FIG. 1B is a cross-sectional view of another prior art recirculating type cleaner showing a pertinent part thereof;

FIG. 1C is a cross-sectional view of still another prior art recirculating type cleaner showing a pertinent part thereof;

FIG. 1D is a cross-sectional view of yet another prior art recirculating type cleaner showing a pertinent part thereof;

FIG. 1E is a cross-sectional view of another prior art recirculating type cleaner showing a pertinent part thereof;

FIGS. 2A1 and 2A2 are cross-sectional views of other prior art recirculating type cleaners showing pertinent parts thereof;

FIG. 2B is a cross-sectional view of another prior art recirculating type cleaner showing a pertinent part thereof;

FIG. 2C is a cross-sectional view of yet another prior art recirculating type cleaner showing a pertinent part thereof;

DETAILED DESCRIPTION OF THE PREFERRED EMBODIMENTS

Figure 3A:
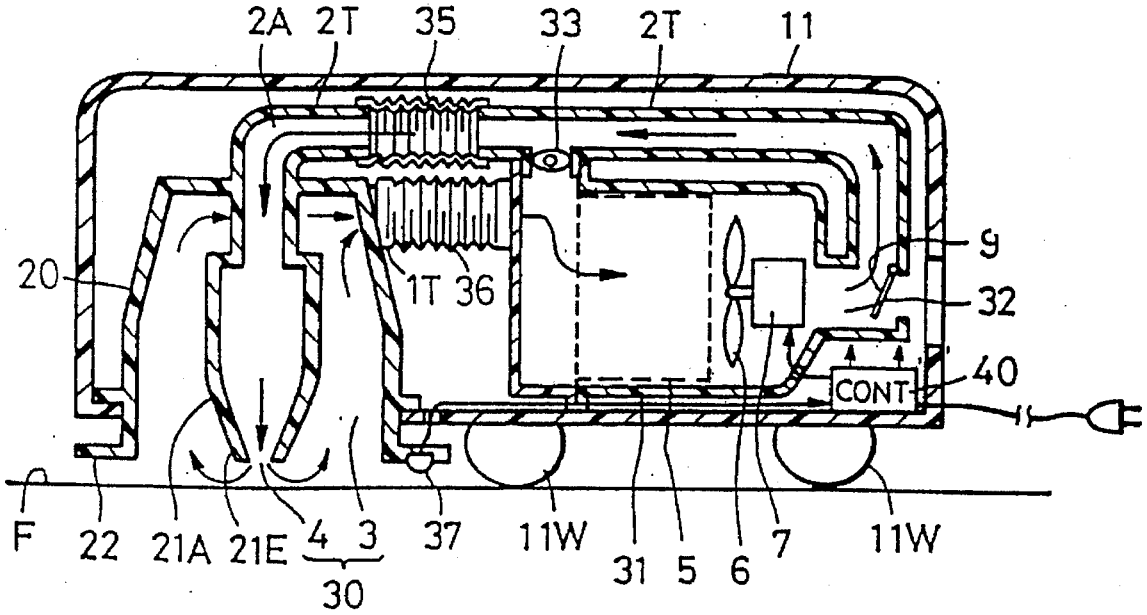
FIG. 3A is a cross-sectional view of the principal parts of the cleaner on which the present invention is based.

First, the general construction and the dust collecting head 20 of the recirculating type cleaner as disclosed in the parent patent application on which the present invention is based will be described with reference to FIG. 3A–3B.

In this embodiment the dust collecting head 20 is inserted in a cleaner housing 11 from the bottom opening thereof and mounted in the housing. The head 20 comprises a central jet nozzle 21A terminating in an outlet means 4 for discharging recirculating flow at the lower end thereof. The upper end of the jet nozzle 21A is connected via a recirculating tube 2T with a rear conduit 32 leading from a dust collecting chamber 31. Mounted in the dust collecting chamber 31 adjacent the rear conduit 32 is a motor 7 which drives a fan 6 to create a vacuum or a negative pressure in the chamber 31.

A filter 5 is accommodated in the chamber 31 which is in fluid communication with a suction port 3 of the dust collecting head 20 via a suction tube 1T on the side of the open forward end of the filter 5.

Figure 3B:
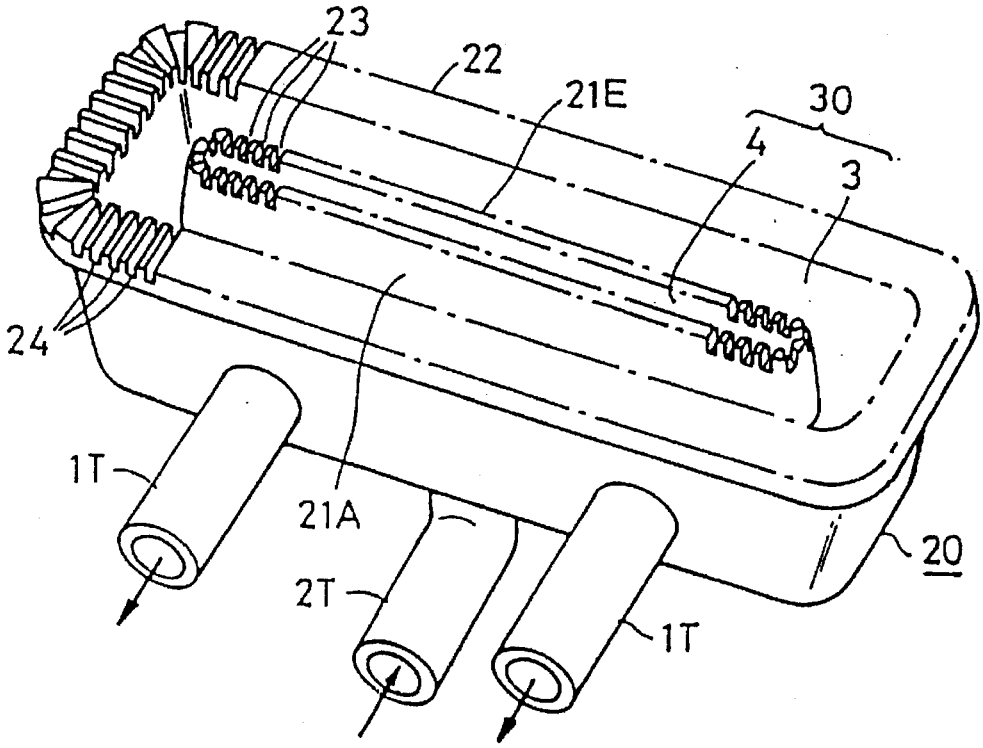
FIG. 3B is a perspective view of the dust collecting head of the cleaner shown in FIG. 3A.

As shown in FIGS. 3A and 3B, the jet nozzle 21A is tapered in cross section toward the lower end or forward end portion 21E to define a constricted orifice such that the direction of discharge is approximately normal to the lower end plane of the suction port 3 so as to produce a jet in a direction perpendicular to the surface F to be cleaned. The peripheral wall of the jet nozzle 21A defines a boundary wall to separate the suction region inside the port 3 from the outlet means 4.

The outlet means 4 may comprise a single jet as shown in FIG. 3B or a plurality of jets. The outer peripheral wall of the dust collecting head 20 separates the suction region inside the port 3 from the atmosphere. The lower end of the outer peripheral wall of the head is turned outwardly to define a flange 22 extending parallel to the surface or floor F to be cleaned.

Wheels 11W support the cleaner so as to maintain a spacing between the flange 22 and the surface F to be cleaned. By way of example, the distance between the flange 22 and the surface F to be cleaned may be detected by a floor sensor 37 such as a light sensor or an ultrasonic sensor mounted on the flange 22 so that the distance between the flange 22 and the surface F may be automatically adjusted by a drive means (not shown) which may be actuated under the control of a controller 40 in response to the detected distance. The recirculating tube 2T and suction tube 1T may include flexible joint tubes 35 and 36, respectively intermediate their opposite ends so as to permit the adjustment of the elevation of the dust collecting head.

As best shown in FIG. 3B, the lower end surface of the jet nozzle 21A is formed over its full periphery with narrow channels 23 establishing fluid communication between the outlet means 4 and the suction port 3, and likewise the end surface of the flange 22 is formed with narrow channels 24 communicating the suction port 3 with the atmosphere. These channels 23, 24 serve to significantly reduce the suctioning force on a large piece of paper which is large enough to cover the entire dust collecting port means 30 comprising the outlet means 4 and the suction port means 3.

In use, the vertically directed jet impacts on the surface F being cleaned and parts forward and rearward (right and left as viewed in FIG. 3A) to blow up the dust.

Now considering one point on the surface F being cleaned as the dust collecting port means 30 is moved forwardly (from right to left as viewed in FIG. 3A) in its forward sweeping stroke, said point first enters the region of suction port 3 where it is exposed to the airflow from the right, then it moves to directly under the outlet 4 where it is exposed to the air jet from above, and moves on until it again enters the region of suction port 3 where this time it is exposed to the airflow from the left. In this way any point on the surface being cleaned is evenly exposed to the airflow from all directions, so that a thorough cleaning of even a carpet or the like may be expected.

If the discharge angle of jet were less than 60°, the air jet would blow from only one direction, with the result that some of the dust would be likely to remain unremoved. In contrast, according to this embodiment of the invention the jet is directed generally almost perpendicular to the surface being cleaned, whereby the air flow may reach the roots of the carpet piles or the bottom of recessed grooves to blow up and loosen the dust at the roots or the bottom. Producing such an air jet does not cause so great a build-up of the fan back pressure, but makes it possible to utilize the energy of the after-flow air (air flow downstream of the suction fan) more effectively as compared to a mechanical brush or beating means.

Following are the results of experiments conducted on the recirculating type cleaner of FIG. 3A on which the present invention is based and which is provided with the dust collecting head 20 of FIG. 3B. These experiments were conducted on a recirculating type cleaner which was modified from a commercially available non-recirculating type cleaner operable at an apparent power of 900 W at max. and adjustable power levels of seven steps. The discharge angle of recirculated jet relative to the floor surface was about 90°. The dust collecting port means was constructed as illustrated in FIG. 3A. The cleaning test was made on a floor having a straight groove extending at 45° with respect to the sweeping direction of the cleaner according to JIS C-9108 in which the amount of sand removed from the groove was measured. With the cleaner according to this invention the amount of sand removed per unit air power was 2.4 times as much as that of the conventional cleaner. In addition, an increase by a factor of 1.6 in the electric power to air power conversion efficiency, is obtainable by optimizing the fan design for the reduced power. It was thus found that in total the cleaning amount per unit electric power or the cleaning efficiency can be 3.84 times as much as that of the conventional cleaner.

Another test was made on a carpet having sand scattered at the roots of the carpet piles, and it was found that remarkably higher cleaning efficiency was obtained. This is because the vertically oriented jet acts to blow up the sand from the roots of the carpet wool.

These values of cleaning efficiency were achieved in the case where the recirculation ratio was about 100%, in which the temperature rise of the fan motor might pose a problem. However, a satisfactory cleaning efficiency may be realized even if the power of the fan motor is reduced to less than 80%, to about 1/3.84, for example. Accordingly, it is possible to keep the temperature rise of the fan motor down to below the safety level. It is thus to be appreciated that the cleaner providing an air jet at an angle of 90° against the surface being cleaned is superior to the conventional cleaner operating with a beating and vibrating system, with the power brush means or with a jet system having a jet discharge angle of less than 60°.

The nozzle 21A of FIG. 3A performs the function of carrying out the 'prior bending' or forward bending of piles (bending the pile down forwardly to the direction of the sweeping stroke of the cleaner) by a forward (leftward) fraction of the jet flow and the 'inverted bending' or rearward bending of piles (bending the piles down rearwardly, to the reverse direction of the sweeping stroke of the cleaner) by a rearward (rightward) fraction of the jet flow. In this embodiment, however, since both the prior forward bending and the inverted rearward bending are effected by the air jet flow alone, a distinct gorge of pile is hard to be formed at the boundary between the oppositely bent regions of the piles in the case of either a short-piled or medium long- or long-piled carpet because in the former case the piles are too short to be sufficiently bent down while in the latter the piles tend to be intertwined to resist being bent down. Nevertheless, in the case of the short-piled carpet, the air jet can reach the roots of the carpet piles to effect the cleaning whereas in the case of the long-piled carpet the air jet cannot reach the roots of the carpet piles, resulting in a reduced cleaning efficiency.

The present invention contemplates overcoming these disadvantages by providing means for positively effecting the forward (leftward) and inverted rearward (rightward) bending of pile. The construction of the invention will be described with reference to FIGS. 4 to 11B, 12, 13 and 14 illustrating various forms of the dust collecting head 20 equipped with means for creating a distinct gorge at the boundary between the oppositely bent regions of piles with the aid of mechanical contact with the carpet piles.

Figure 4:
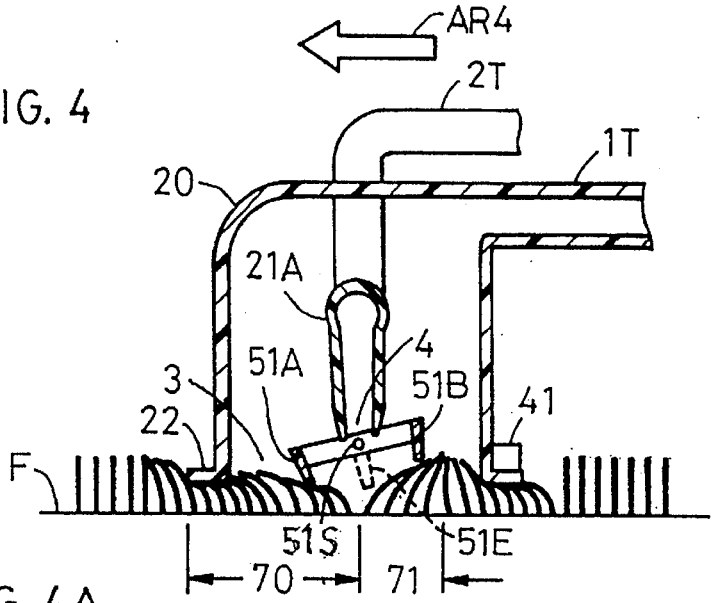
FIG. 4 is a cross-sectional view of the dust collecting head of the cleaner according to an embodiment of the present invention.
Figure 4A:
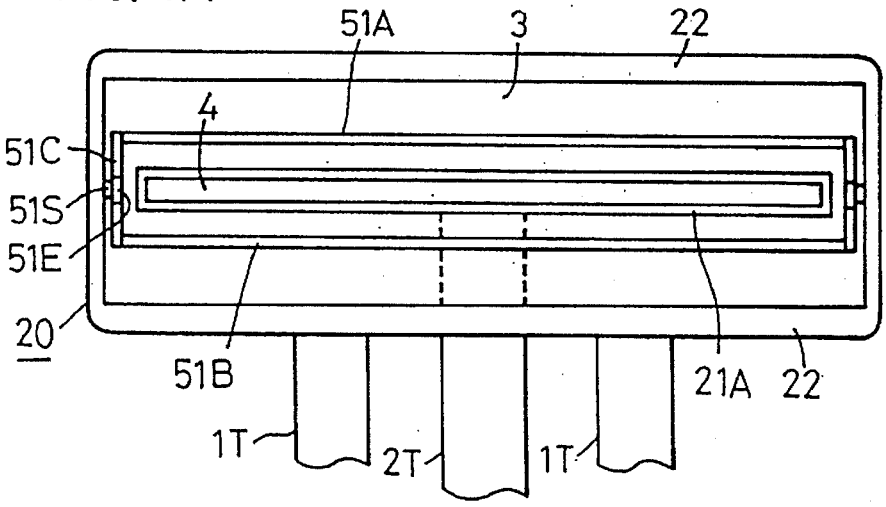
FIG. 4A is a bottom plan view of the dust collecting head shown in FIG. 4.

FIG. 4 illustrates an embodiment of the dust collecting head in a vertical cross-section where a pair of opposed mechanical pile bending contact members 51A and 51B which may comprise plate-like beams, rods or rollers are provided forwardly and rearwardly of the jet nozzle 21A in the dust collecting head 20 of FIG. 3A as viewed in the direction of the sweeping stroke, the jet nozzle having an elongated outlet 4 similar to that shown in FIG. 3B. FIG. 4A is a bottom view of the the dust collecting head shown in FIG. 4, and FIG. 4B is a perspective view of a cradle assembly 51 comprising the pile bending contact members 51A, 51B.

The contact members 51A, 51B in the form of plate-like beams are provided in parallel, spaced apart relation and interconnected at their upper parts of left and right respective ends with connecting members 51C to constitute the cradle assembly 51. Each of the connecting members 51C has a pivot shaft 51S extending therefrom at the middle thereof which is pivotally supported in left and right shorter end walls of the head 20.

When the dust collecting head 20 is at rest, the lower edges of the contact members 51A, 51B are in light (shallow) contact with the wool. As the dust collecting head 20 is moved in the direction as shown by an arrow AR4 in FIG. 4 in its forward sweeping stroke from its at-rest position, the leading contact member 51A is displaced downwardly with its lower edge subjected to a counterclockwise rotary force around the pivot axis 51S by the piles while the trailing contact member 51B is displaced upwardly above the piles. The contact member 51A pushes the piles down forwardly to thereby form a forwardly bent region 70 of the piles. As the sweeping stroke proceeds, the piles whose tips have moved past the contact member 51A are inverted due to their own resiliency and the jet flow to define a rearwardly bent region 71 of the pile. Formed at the bounds between the forwardly bent and rearwardly bent regions 70 and 71 is a gorge of piles as shown where the roots of the piles are exposed to the jet flow to facilitate removing the dust at the gorge effectively. In FIG. 4, as the dust collecting head 20 is moved in the direction opposite from that shown by the arrow AR4 in its backward sweeping stroke, the leading contact member 51B is displaced downwardly while the trailing contact member 51A is displaced upwardly, whereby the same action as described above occurs.

Figure 4B:
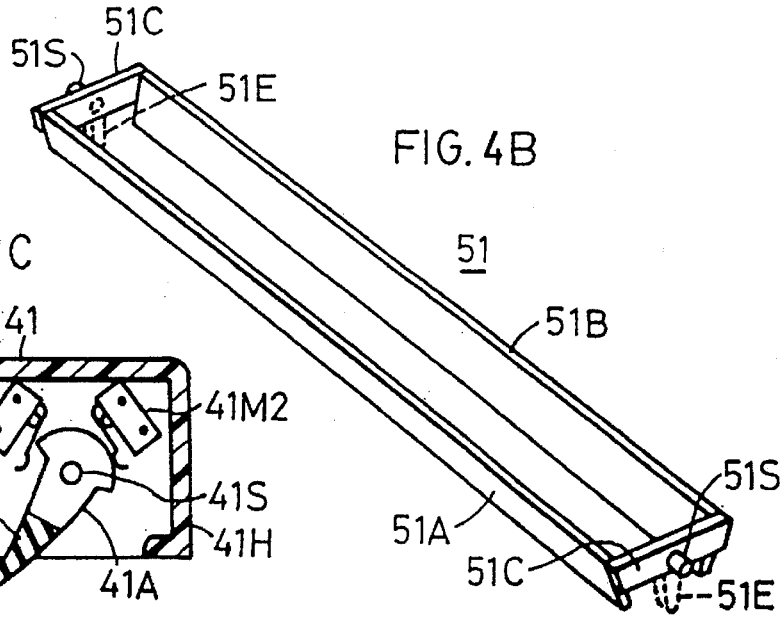
FIG. 4B is a perspective view of the cradle assembly 51 in FIG. 4.

As shown in broken lines in FIGS. 4 and 4B, each of the connecting members 51C may have a contact rod 51E extending downwardly therefrom at the middle thereof beyond the lower edges of the contact members 51A, 51B. With this construction, as the dust collecting head 20 is moved, the contact rods 51E are rotated by the piles whereby the switchover between the downward and upward displacements of contact members 51A, 51B depending on the direction of the sweeping stroke may be effected more positively.

Figure 4C:
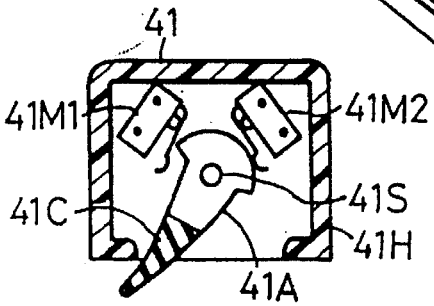
FIG. 4C is an enlarged cross-sectional view of the direction sensor in FIG. 4.

Alternatively, as illustrated in FIG. 4C, a sweeping direction sensor 41 may be mounted on the flange 22 to detect the direction of the sweeping stroke, so that an electric actuator is energized to force the contact member 51A up and the contact member 51B down when the sweeping stroke is in the direction indicated by arrow AR4 and to force the contact member 51A down and the contact member 51B up when the sweeping stroke is in the opposite direction.

An example of the fundamental construction of the sweeping direction sensor 41 is illustrated in FIG. 4C. The sensor 41 comprises a case 41H in which a pivotable lever 41A is rotatably supported at its upper head portion by a shaft 41S. The lever 41A has a flap 41C extending from its lower end which is formed of a deformable material such as rubber, so that the lever is pivoted in the direction of movement of the head 20 due to friction between the flap 41C and the floor. FIG. 4C shows the attitude of the pivotable lever 41A when the head 20 of FIG. 4 is being moved in the direction opposite from that indicated by the arrow AR4 during the sweeping operation. In this position, the semi-circular head portion of the lever 41A turns a first microswitch 41M1 off and keeps a second microswitch 41M2 in its on position. When the sweeping stroke is switched to the direction indicated by the arrow AR4 in FIG. 4, the pivotable lever 41A is tilted in the opposite direction to energize the first microswitch 41M1 and release the second microswitch 41M2 to its off position. The ON-OFF states of the microswitches 41M1 and 41M2 may be detected by the controller 40 (FIG. 3A) to determine the direction of movement of the head 20.

Figure 5:
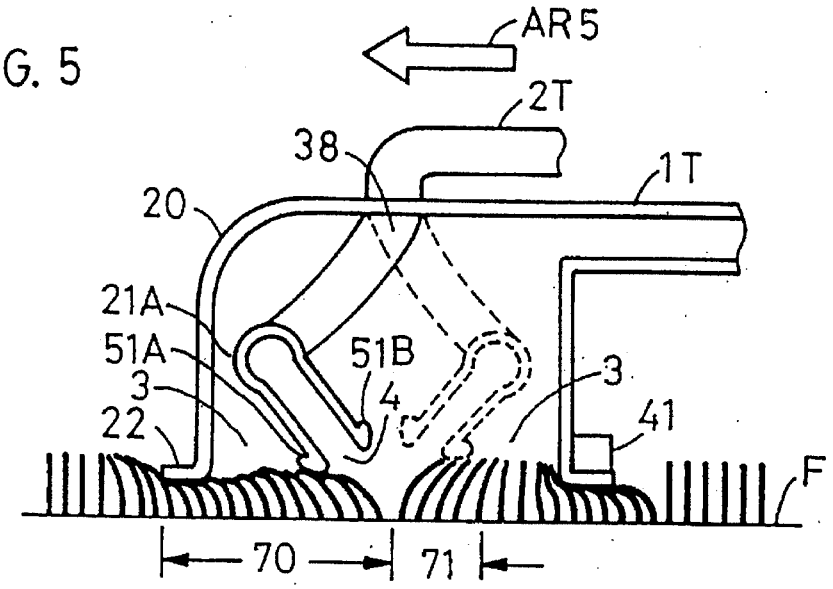
FIG. 5 is a cross-sectional view of the principal parts of the dust collecting head according to another embodiment of the present invention.

FIG. 5 illustrates an alternate form where first and second contact members 51A and 51B similar to those shown in FIG. 4 are affixed integrally to the outer wall of the jet nozzle 21A near the lower end outlet 4. In this embodiment, the nozzle 21A is arranged such that the upper portion of the nozzle is tilted forwardly in accordance with the direction of sweeping as shown in solid lines during the forward sweeping stroke of the dust collecting head 20 as indicated by an arrow AR5, and when the sweeping direction is reversed the nozzle 21A is tilted in the opposite direction as shown in broken lines. It should be noted that in either tilted position of the nozzle 21A the outlet 4 is directed at the center of the dust collecting port. The upper end of the nozzle 21A is connected via a flexible hose 2Tf with the recirculating tube 2T.

Figure 6:
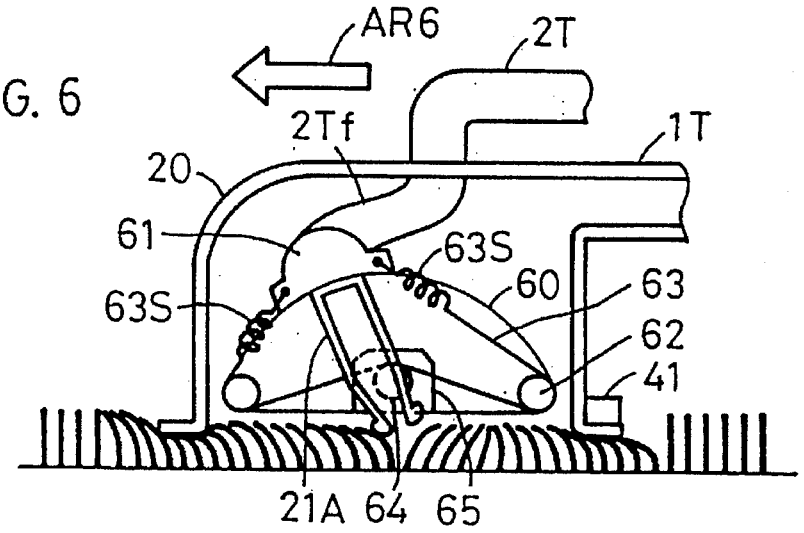
FIG. 6 is a cross-sectional view of the nozzle moving mechanism in FIG. 5.

An example of a mechanism for effecting pivotal movements of such a nozzle 21A is illustrated in FIG. 6. Such nozzle moving mechanisms are provided at both ends of the long nozzle, that is, perpendicular to the plane of the drawing. More specifically, a pair of opposed arcuate-shaped side plates 60 are provided at both ends of the long nozzle. A slide carriage 61 carrying the nozzle 21A extends between the opposed arcuate-shaped side plates 60 and slides on the top edges of the arcuate side plates 60. A pair of idler wheels 62 are mounted to the side plate 60 near each end of the plate. Trained around the idler wheels 62 is a belt 63, the two ends of which are connected to the slide carriage 61 by coil springs 63S. The belt 63 is in frictional driven engagement with a drive wheel 64 intermediate the pair of idler wheels 62, the drive wheel being fixed to an output shaft of a motor 65.

With this arrangement, activation of the motor 65 causes the carriage 61 to slide along the arcuate track, so that the nozzle 21A mounted to the carriage 61 is pivoted around a point on an extension of the central line of the nozzle. The direction of rotation of the motor 65 may be controlled by the controller 40 (FIG. 3A) depending on the direction of movement of the head 20 as detected by the direction sensor 41. Microswitches (not shown) are mounted on the side plate 60 at two predetermined limit positions at which the carriage 61 is to be stopped. The controller 40 will deactivate the motor 65 in response to either one of the microswitches being engaged by the moving carriage 61.

Figure 7:
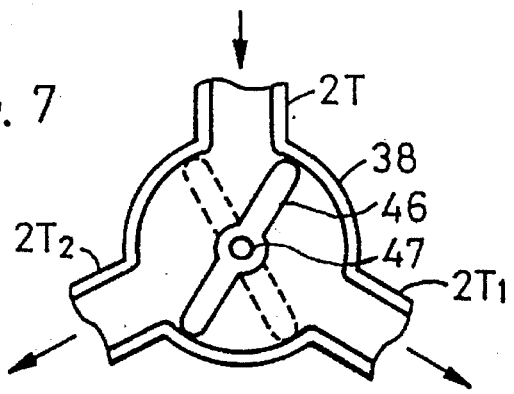
FIG. 7 is an enlarged cross-sectional view of the selector valve 38 in FIG. 5.

In the embodiment of FIG. 5, the need for providing the nozzle moving mechanism as shown in FIG. 6 may be eliminated by disposing two fixed nozzles 21A in oppositely tilted positions as shown in solid and broken lines, respectively in FIG. 5. In that case, the recirculated air may be discharged selectively through either one of the two nozzles under the control of a selector valve 38 as shown in FIG. 7 depending on the sweeping direction. FIG. 7 illustrates an example of the selector valve 38 useful in this invention which comprises a butterfly valve member 46 which may be rotated through about 67° about a valve stem 47 by a rotary solenoid. In the position of the valve member 46 shown in solid lines in FIG. 7 the recirculating tube 2T is in fluid communication with a branched tube $2T_2$ leading to a corresponding one of the nozzles 21A. When the valve member 46 is shifted to the position shown in broken lines in FIG. 7, the recirculating tube 2T is communicated with the other branched tube $2T_1$ leading to the other of the nozzles 21A.

Figure 8A:
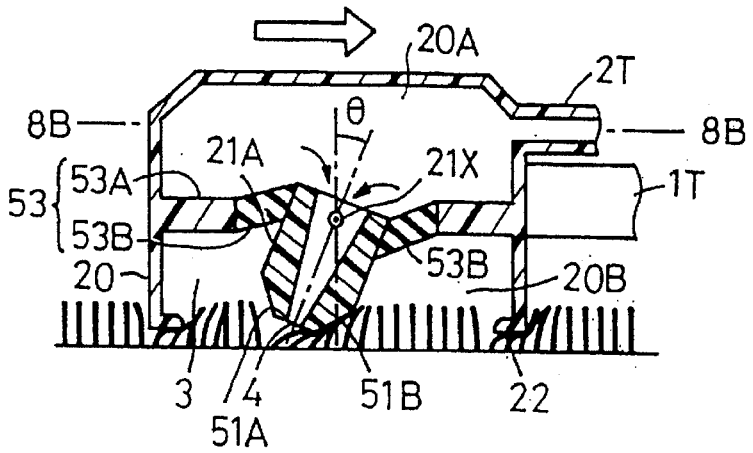
FIG. 8A is a vertical cross-sectional view of the principal parts of the dust collecting head according to still another embodiment of the present invention.
Figure 8B:
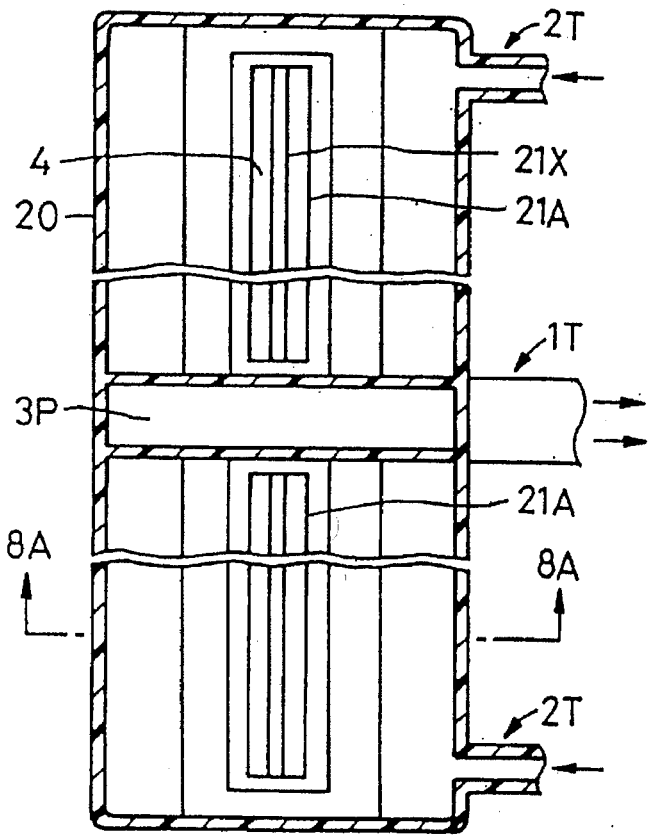
FIG. 8B is a horizontal cross-sectional view of the dust collecting head taken along line 8B—8B in FIG. 8A.

FIG. 8A–8B illustrates a still further alternate form where the lower end of the nozzle 21A serves also as contact members 51A and 51B as in the embodiment of FIG. 5, but the nozzle 21A is arranged to be naturally tilted as shown in FIG. 8A due to the lower end of the nozzle being engaged by the piles during the sweeping movement so as to direct the air jet toward a gorge of piles being thus formed.

FIG. 8B is a horizontal cross-sectional view of the dust collecting head 20 taken along line 8B–8B in FIG. 8A while FIG. 8A is a vertical cross-sectional view of the head 20 taken along line 8A—8A in FIG. 8B. In this embodiment, the interior of the head 20 is divided into two chambers, upper and lower chambers 20A and 20B, respectively by a partition 53 comprising a pair of opposed rigid ledge portions 53A integral with and extending from the side walls of the head 20 and resilient sheets 53B as made of foamed rubber joined to and extending from the inner peripheries of the ledge portions 53A toward the center of the head. The upper chamber 20A is further divided at the center of the length of the chamber into two compartments by a passage 3P communicating the suction port means 3 with the suction tube 1T. Two transversely long nozzles 21A extend straight downwardly from the respective compartments of the upper chamber 20A through the center of the partition 53 into the lower chamber 20B.

Each of the long nozzles 21A is rotatably supported at the upper portion of its two ends by a pivot shaft 21X. The inner periphery of the resilient sheet 53B surrounds the nozzle 21A and is bonded to the outer peripheral wall of the corresponding nozzle 21A to thereby separate the upper and lower chambers 20A, 20B from each other in hermetically sealed relation. The passage 3P is connected with the suction tube 1T, and the upper chamber 20A in the head 20 is communicated with the recirculating tube 2T. The recirculated air is thus passed from the recirculating tube 2T into the the upper chamber 20A whence it is jetted through the nozzles 21A against the surface being cleaned within the lower chamber 20B (suction port means 3).

Each nozzle 21A is held in a position perpendicular to the plane of the partition 53 by the resilient sheet 53B when it is out of engagement with the surface being cleaned. As the head 20 moves with the nozzle 21A in contact with the piles, the lower end of the nozzle 21A is rotated in a direction reverse to that of movement of the head to be tilted to an angle θ at which the resilient force of the resilient sheet 53B is balanced with the frictional force between the nozzle and the piles. The angle θ tends to be small for a short-piled carpet and large for a long-piled carpet. Accordingly, the resilient force of the resilient sheet 53B can be adjusted to provide such an angle θ depending on the length of the carpet piles that the air jet issuing from the nozzle is naturally directed toward the gorge of piles independently on the pile length. For smooth floors other than carpets, the jet flow is directed perpendicularly to the floor surface since the nozzle 21A is not in contact with the floor.

Figure 9:
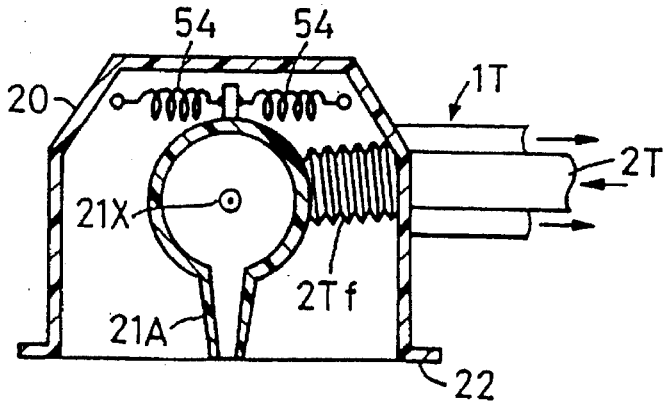
FIG. 9 is a cross-sectional view of an alternate form of the dust collecting head shown FIG. 8A—8B.

FIG. 9 illustrates a yet further alternate form where the nozzle 21A is rotatably supported by a pivot shaft 21X and is connected via a flexible hose 2Tf directly to the recirculating tube 2T. The nozzle 21A is always biased so as to be restored to its vertical neutral position by a pair of springs 54 connected at one end to the top wall of the nozzle and at the other end to the inner end wall of the head.

Figure 10A:
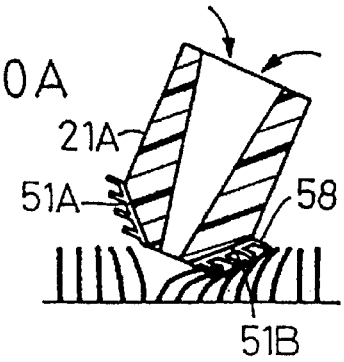
FIG. 10A is a cross-sectional view of an example of the tip portion of the nozzle.
Figure 10B:
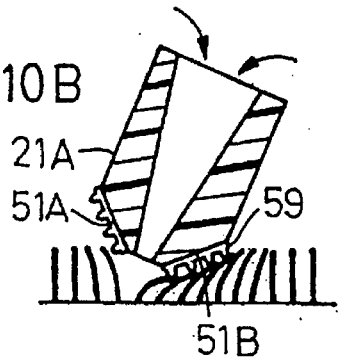
FIG. 10B is a cross-sectional view of another example of the tip portion of the nozzle.

FIGS. 10A and 10B illustrate exemplary forms of contact members 51A, 51B useful in the embodiments of FIGS. 4, 5, 6, 8A and 9. The contact members 51A, 51B illustrated have combing face means affixed to the surface thereof which comprise either small protuberances 59 or bristles 58 oriented in a particular direction. The protuberances 59 may be molded from rubber or the like. The bristles 58 may comprise a bristle-implanted cloth, e.g., formed of polyimide (similar to what is commercially available and known as 'etiquette clothbrush') with the bristles forced down in a particular direction while heat treated. Desirably, the bristles are oriented in the direction shown in FIG. 10A. During the cleaning operation, the combing face means, either in the form of protuberances 59 or in the form of bristles 58, serve to comb through entangled piles of a carpet and allow the piles to readily self-spring back after the passage through the combing face means as well as aiding in dislodging and suctioning up pieces of thread, hair and the like entangled in the carpet. Such combing face means may be applied to the pile-bending contact members and/or lower end face of the nozzle in any of the embodiments illustrated herein.

Figure 11A:
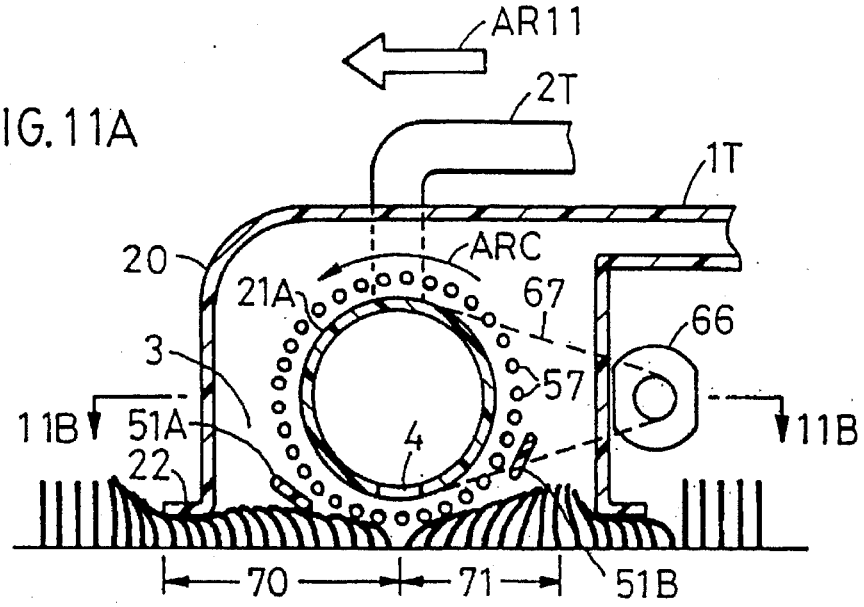
FIG. 11A is a cross-sectional view of the principal parts of the dust collecting head according to another embodiment of the present invention.
Figure 11B:
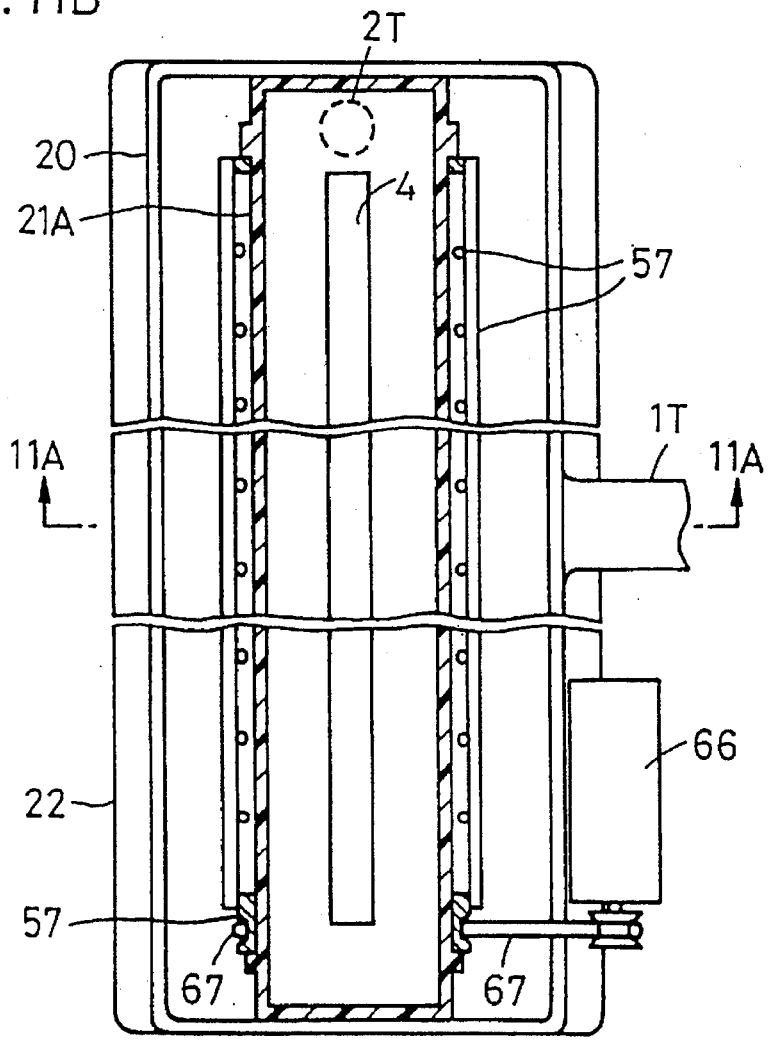
FIG. 11B is a horizontal cross-sectional view of the dust collecting head taken along line 11B—11B in FIG. 11A.

FIG. 11A is a vertical cross-sectional view showing still another alternate form of the head 20 where the inversion of carpet pile bend is carried out by mechanical contact. FIG. 11B is a horizontal cross-sectional view of the head taken along line 11B—11B in FIG. 11A. The nozzle 21A is formed as a hollow cylinder having a horizontal axis with an outlet 4 formed through the lower wall of the cylinder. The recirculating tube 2T extends from top of the side wall of the cylindrical nozzle 21A. Surrounding the cylindrical nozzle 21A is a rotatable cylindrical cage or mesh 57 which is rotatively driven by a motor 66 and a belt 67 in a direction indicated by an arrow ARC when the dust collecting head 20 is moved in a direction indicated by an arrow AR11. The outer peripheral surface of the cage 57 has such an appropriate coefficient of friction against carpet wool as to prevent slippage but not to pluck off the piles. Contact members 51A and 51B act in a similar manner to those shown in FIG. 4. When the head 20 is moved in a direction opposite to that indicated by the arrow AR11 during the sweeping stroke, the contact member 51B is lowered to the piles and the cage 57 is is rotated in a direction opposite to that indicated by the arrow ARC. As shown, the pile bend is inverted (rearwardly bent down) with the aid of frictional contact by the cage 57.

This arrangement assures more positive action than the air jet alone and is operable on considerably long piles up to about 3 cm. More specifically, the cage 57 is operable to act on any long piles whose tips have not yet passed the contact member 51A and still remain bent to the stroke direction, by pulling such piles out of the contact member 51A and forcedly inverting them. It is thus to be appreciated that this arrangement is capable of inverting the piles without being significantly affected by the length of the piles. While in FIG. 11A–11B the outlet 4 is illustrated as being formed through the lower wall of the cylinder 21A, it may, of course, be possible to dispose a nozzle 21A having a cross-sectional profile as shown in FIG. 4 within the cage 57.

Figure 12:
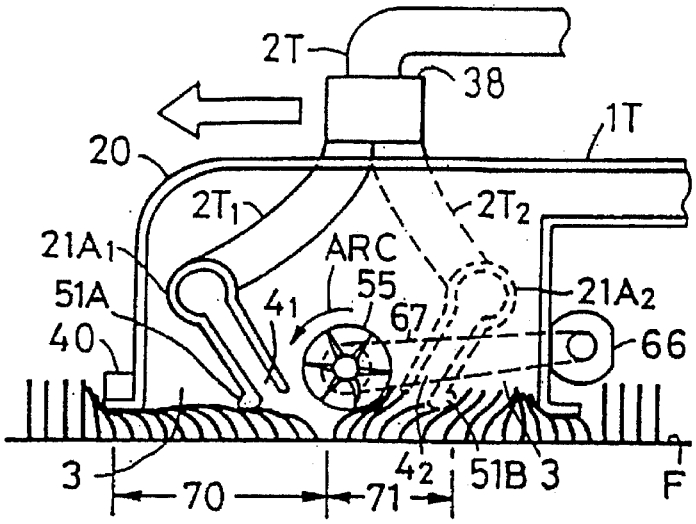
FIG. 12 is a cross-sectional view of the principal parts of the dust collecting head according to still another embodiment of the present invention.

FIG. 12 illustrates a yet further alternate form wherein a rotary power brush 55 is utilized to invert the pile bend. In this embodiment two nozzles are provided. One jet nozzle $21A_1$ shown in solid lines is for the leftward (forward) sweeping stroke and is connected to a branched recirculating tube $2T_1$. The other jet nozzle $21A_2$ shown in broken lines is for the rightward (rearward) sweeping stroke and is connected to a branched recirculating tube $2T_2$. The recirculating conduit 2T is selectively communicated with either the branched recirculating tube $2T_1$ or the branched recirculating tube $2T_2$ under the control of a selector valve 38 as shown in FIG. 7 depending on the sweeping direction so that the air jet may be discharged through the outlet $4_1$ of the nozzle $21A_1$ during the leftward sweeping stroke and through the outlet $4_2$ of the nozzle $21A_2$ during the rightward sweeping stroke. The lower ends of the nozzles $21A_1$ and $21A_2$ are configured to serve as pile-bending contact members 51A, 51B as well. The rotary power brush 55 is rotated, i.e., driven by a motor 66 and a belt 67 in a direction indicated by an arrow ARC during the leftward sweeping stroke and is reversely rotated during the rightward sweeping stroke.

Figure 13:
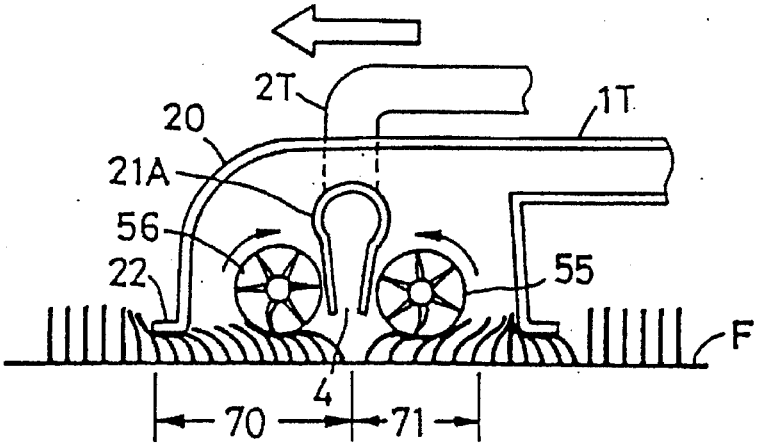
FIG. 13 is a cross-sectional view of the principal parts of the dust collecting head according to still another embodiment of the present invention.

FIG. 13 illustrates another alternate form wherein two rotary power brushes 55 and 56 are utilized. During the leftward (forward) sweeping stroke the power brush 56 is used for the prior bending-down (forwardly bending) of piles while the power brush 55 is used for inverting the pile bend. The nozzle 21A is oriented perpendicularly to the plane of the floor surface F with the jet outlet 4 at the lower end thereof elevated so as not to contact the carpet wool. The power brushes 56, 55 are always rotated in the directions indicated by arrows regardless of the sweeping direction such that the lower portions of both of the brushes are moved away from the nozzle. The functions of the two power brushes 56 and 55 are alternated with each other between the prior pile-bending and the pile inverting, on the sweeping direction.

While the recirculating type of cleaner incorporating the dust collecting head 20 of FIG. 4, 5, 11A, 12 or 13 is designed to be capable of effective cleaning in either of forward and rearward sweeping directions as described above, it may be desirable to have an arrangement designed to be effectively operable in only one sweeping direction such as forward (leftward) sweeping direction without aiming at an increased cleaning efficiency in the other sweeping direction for the benefit of simplification and cost reduction.

Figure 14:
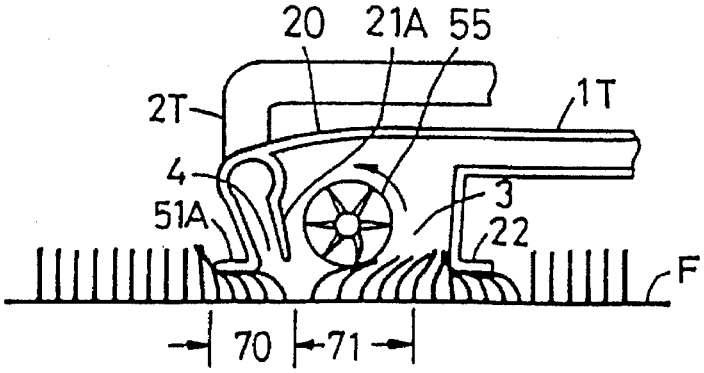
FIG. 14 is a cross-sectional view of the principal parts of the dust collecting head according to yet another embodiment of the present invention.

An example of such a one-way sweeping arrangement is illustrated in FIG. 14. This embodiment is designed to realize a high cleaning efficiency during the leftward sweeping stroke as viewed in the drawing. As illustrated, the nozzle 21A is formed integrally with the front side wall of the dust collecting head 20 and the flange 22 of the head 20 is configured to serve as a contact member 51A as well. A rotary power brush 55 for inverting the pile bend is rotated in a direction indicated by an arrow such that the lower portion of the brush is moved away from the nozzle 21A. It will be obvious that if desired in this embodiment, the nozzle 21A may be provided inward apart from the front side wall of the head 20 so that suction port means 3 may be provided on both sides of the nozzle.

It is preferable that the vanes of the power brushes 55, 56 in the embodiments of FIGS. 12, 13 and 14 be twisted rather than parallel relatively to the axis of rotation of the brush to pass the jet flow therethrough. Further, while it is assumed that in the embodiments illustrated all the vanes of the power brush extend continuously along the axis of rotation of the brush (perpendicularly to the plane of the drawing), the vanes may be arranged in a plurality of sets axially spaced in the power brush 55 of FIG. 12, for example.

As described hereinabove, the dust collecting head 20 of FIG. 4, 5, 6, 8A, 9, 11A, 12, 13 or 14 for the cleaner according to the present invention is equipped with the contact 51A and/or power brush 56 as means for bending the piles down forwardly of the jet outlet 4 as viewed in the sweeping direction when moving the dust collecting head 20 across the carpet to be cleaned in either a forward or rearward (leftward or rightward) sweeping stroke, and the jet outlet 4 and/or contact member 51B and/or power brush 55 and/or cage 57 are used for inverting the pile bend (bending piles down in a direction opposite to the sweeping direction). The air jet from the outlet 4 is directed against the dust exposed at a gorge of the piles created at the bounds between the forwardly bent and rearwardly bent regions 70, 71 by the prior pile bending means and the pile bend inverting means to loosen or release the dust, which is then easily removed even from the roots of the pile to be drawn into the suction port 3. The cleaning efficiency may thus be improved up to nearly 100% with the aid of the prior pile-bending means, the pile bend inverting means and means blowing the created gorge of piles.

I claim:

1. A recirculating type cleaner comprising:

a housing defining a dust collecting chamber therein;

a dust collecting head having dust collecting port means in the bottom thereof, said dust collecting head being movable in a fore and back sweeping direction relative to the piles of a carpet being cleaned;

nozzle means provided in said dust collecting head and having an elongated air outlet at the lower end of said nozzle means for issuing air downwardly, said air outlet being oriented longitudinally in a direction perpendicular to said sweeping direction;

a fan for discharging the air out of said dust collecting chamber;

a suction tube for passing the air drawn from within said dust collecting head into said dust collecting chamber;

a recirculating tube passing at least a fraction of the after-flow air of said fan to said nozzle means for discharge from said dust collecting head through said elongated air outlet; and pile bending means provided in said dust collecting head for contacting carpet piles being cleaned within at least a portion of the region of said dust collecting port means to bend the piles down to the sweeping direction of said head to thereby open a gorge in the piles, said pile bending means including an elongated first beam-like contact member extending along said elongated air outlet on one side of the nozzle means, and support means for pivotally supporting said beam-like member;

said nozzle means being oriented so that the air discharged through said elongated air outlet is directed to the bottom of said gorge.

2. A recirculating type cleaner according to claim 1, wherein said pile bending means includes a second elongated beam-like contact member extending along said elongated air outlet on the side of the nozzle means opposite to said one side, and connecting means for interconnecting corresponding opposite ends of said first and second elongated beam-like contact members to one another respectively, said support means including a pivot shaft mounted in said connecting means.

3. A recirculating type cleaner according to claim 2, further comprising turning means for pivotally turning said pile bending means until the one of said first and second contact members which leads the other of said contact members in the sweeping direction is brought into contact with the carpet piles.

4. A recirculating type cleaner according to claim 3, wherein said turning means includes contact means affixed to and extending downwardly from said connecting means to engage a surface being cleaned so as to be turned in concert with the sweeping movement of the cleaner.

5. A recirculating type cleaner according to claim 1, further comprising pile bend inverting means for bending down the piles lying in a region just behind said gorge in a direction reverse to said sweeping direction to widen the gorge opening.

6. A recirculating type cleaner according to claim 5, wherein said pile bend inverting means includes contact means for bending the piles down by mechanical contact with the piles lying just behind said gorge.

* * * * *